United States Patent [19]

Fresnel

[11] 4,179,863

[45] Dec. 25, 1979

[54] APPARATUS FOR SECTIONING THERMOPLASTIC SHEATH AND PLACING RESULTING SLEEVES AROUND CONTAINERS

[76] Inventor: Jacques Fresnel, 15 Blvd. Lannes, Paris, France, 75116

[21] Appl. No.: 930,183

[22] Filed: Aug. 1, 1978

[30] Foreign Application Priority Data

Aug. 3, 1977 [FR] France ..... 77 23873
May 2, 1978 [FR] France ..... 78 12891

[51] Int. Cl.[2] ..... B65B 53/02; B65B 61/00
[52] U.S. Cl. ..... 53/295; 53/297
[58] Field of Search ..... 53/291, 292, 293, 294, 53/295, 296, 297

[56] References Cited

U.S. PATENT DOCUMENTS 3,910,013 10/1975 Babineau ..... 53/291
4,102,728 7/1978 Smith ..... 53/291 X

*Primary Examiner*—Travis S. McGehee
*Attorney, Agent, or Firm*—Browdy and Neimark

[57] ABSTRACT

An apparatus for automatic cutting at a programmed rate of heat shrinkable plastic sheaths into sections or sleeves suitable for being placed and then heat-shrunk around containers. The apparatus includes means for feeding the plastic sheath in flat and then transporting it under predetermined tension conditions, and at least one vertical assembly for cutting the sheath and supplying the resulting sections or sleeves. The assembly includes four stages or stations positioned around a hollow mandrel on which the continuous sheath is engaged. The stations are constituted respectively by (1) means for eliminating the fold lines or the like from the flat sheath; (2) means for cutting the sheath; (3) staged means at the same time making it possible to keep the mandrel in vertical position and automatically regulating the height and rate of the cutting; and (4) means for guiding and ejecting the sleeves downward from the mandrel. The ejected sleeves are automatically placed around the containers to be covered which are travelling on a conveyor operatively associated with a device for heat-shrinking the sleeves on the containers.

9 Claims, 7 Drawing Figures

APPARATUS FOR SECTIONING THERMOPLASTIC SHEATH AND PLACING RESULTING SLEEVES AROUND CONTAINERS

BACKGROUND OF THE INVENTION

This invention relates to the making of sections or sleeves of sheaths of heat-skrinkable plastic, intended to be placed then heat-shrunk around containers. More particularly, the invention relates to a novel apparatus making possible the continuous, high rate production of such sleeves from a continuous flat sheath strip, the shaping of these sleeves to conform to the containers to be covered and then their automatic placement around these containers.

It is well known to provide containers, such as bottles, aerosol bombs, flasks, food cans and similar objects, of various materials, with a sleeve or protective covering of shrinkable plastic. This sleeve is placed in a relatively loose condition around the container and, after heating to cause shrinking of the plastic, it should perfectly fit the contour of the container. Thus, there are made containers, generally printed, provided with sleeves of transparent thermoplastic or a porous or cellular plastic.

Numerous operating steps are necessary to obtain from the thin plastic sheet, for example of polyvinyl chloride, made heat-shrinkable, a sleeve and fit it to a container provided with its decorated covering. These steps should be automated to achieve a suitable industrial profitability. According to the technique thus far currently used, a plastic film is made into a continuous sheath or covering, then sheath sections are cut in appropriate dimensions and the resulting sleeves, stacked horizontally or vertically in a magazine, are used to feed a machine making it possible to extract the sleeves individually then open them to the desired conformation and place them around the containers to be covered which travel on a conveyor. The sleeves then are subjected to heat-shrinking. This technique is known from French Pat. No. 76.05033 of Feb. 24, 1976 and French Patents of Addition Nos. 76.33691, 77.00209 and 77.19565. The technique is also disclosed in U.S. Pat. No. 769,748.

This known technique is certainly satisfactory but the apparatus for using the sleeves is difficult to regulate, which detracts from its reliability. Furthermore, production rates are relatively limited because of the complexity of the step and stages for opening the sleeves. Finally, the presence of two fold lines on the sleeves placed on the containers creates difficulties during the final heat shrinking operation.

SUMMARY OF THE INVENTION

It is the principal object of the present invention to remedy the various drawbacks noted above.

It is another object to provide an apparatus for the production and placing, at a high rate, of sleeves already having the general shape of the containers to be covered.

It is an additional object of the present invention to provide an automatic apparatus that uses directly, as raw material, the continuous, flat plastic sheath film, rather than stacks of sheath sections, and which performs the series of operations of shaping, cutting, guiding and placing of the respective sleeves in a vertical line running over a series of containers travelling on a conveyor.

The apparatus according to the invention is characterized in that it essentially comprises, arranged on a frame:

(a) means for feeding a plastic sheath in flat form and then transporting it as a continuous strip under predetermined tension conditions; and (b) at least one vertical assembly which includes a station for cutting the sheath and supplying the sections or sleeves to a stage in which the sleeves are placed around the containers.

The assembly includes arranged around a hollow mandrel on which the continuous sheath is engaged in a downward direction, stations which can be considered to be:

means for eliminating the two folds of the flat sheath;

means for cutting the sheath;

staged means at the same time making it possible to keep the mandrel in vertical position and automatically regulate the height and rate of the cutting; and means for guiding and ejecting the sleeves downward from the mandrel, these sleeves being then automatically placed around the containers to be covered which are travelling on a conveyor provided with means for heat-shrinking, known per se.

According to a characteristic of the present invention, feeding of flat sheath from the vertical assembly, designated above by the letter (b), is done by means of a closed package containing one or more reels of a sheet of plastic material, which constitute the sheath, and provided with a horizontal slot permitting passage of the continuous strip. This strip, is first subjected to a strong tension, is then slackened to permit further adjustment of a length of predetermined cut, and then is again put under tension over the vertical assembly.

According to another characteristic, the set of operations performed on the sheath is performed around a hollow, carrying mandrel whose section corresponds to the configuration desired for the respective final sleeves. This mandrel is carried by horizontal platforms delimiting several stages and which are provided with retractable pins intended to engage in grooves provided in the mandrel.

According to a variant, the flat thermoplastic sheath is subjected to a percutting operation before being engaged around the upper tapered part of the hollow mandrel. This operation, which can be performed, for example, by toothed blade which penetrates into a rubber counterpart, makes it possible later to obtain a cleaner, faster cut.

Means for taking the fold lines or pleats out of the sheath, just after the latter become engaged around the mandrel, are made up of jaws heated by any known means (electrical, hot air, infrared, etc.) and whose time of contact with the sheath on the mandrel is programmed in sequence with the cutting and as a function of the temperature (generally between 70° and 120° C.). These jaws can be driven by any conventional means which brings them into time contact with or in heating proximity to the sheath.

The means for cutting the sheath into sections or sleeves can advantageously be made up of a rotary device provided with horizontal blades; for example, two blades which penetrate into the sheath after having been put into rotation. However, other equivalent cutting members, such as cutting jaws, a cutting ring or the like, can of course be used. According to a variant, it is possible further to provide, associated with the members for clean cutting of the sheath, a microperforation device intended to create a precut line to obtain special type sleeves.

The stages that follow the cutting means preferably are three and essentially have the function of assuring the support and centering of the mandrel during cutting of the sheath and then the descent and ejection of the sleeves. The actions of these various states, which are at different levels, are performed sequentially, particularly by means of a central camshaft, so that when the machine is running there are always two open stages (i.e., stages which are disengaged from the mandrel) and a closed stage at one level (platform blocking the mandrel) or vice-versa.

The means for guiding the sheath on the mandrel may be made up, on the one hand, of rollers or small wheels with alternating drive, and on the other hand, pin chains driven by the camshaft. Further, according to an important characteristic of the invention, the descent of each cut sheath section and then its ejection at the bottom of the mandrel are facilitated by sending, into this hollow mandrel provided with microperforations preferably oriented downward, of air or any slightly pressurized fluid. This injection of fluid is automatically triggered after the cutting operation and is advantageously performed at two points of the hollow mandrel, under different pressures.

The assembly of elements of the machine is arranged on a frame equipped with a series of disc brake couplings (or equivalents) driven alternately by chain pulleys or the like and which are driven by a single motor or a motor with associated transmission and clutch or the like. According to a possible characteristic of the invention, the frame, in a particularly advantageous practice embodiment, can support several cutting assemblies, for example, two, three or more. Thus, as described in more detail hereinbelow, placing of the sleeves around the containers can be done continuously and at high speed during movement of the containers on the conveyor.

BRIEF DESCRIPTION OF THE DRAWINGS

Other objects, features and characteristics of the invention are to become apparent from the description set out below, relating to a non-limiting embodiment, with reference to the accompanying somewhat schematic drawings.

DETAILED DESCRIPTION OF THE PREFERRED EMBODIMENT

Figure 1:
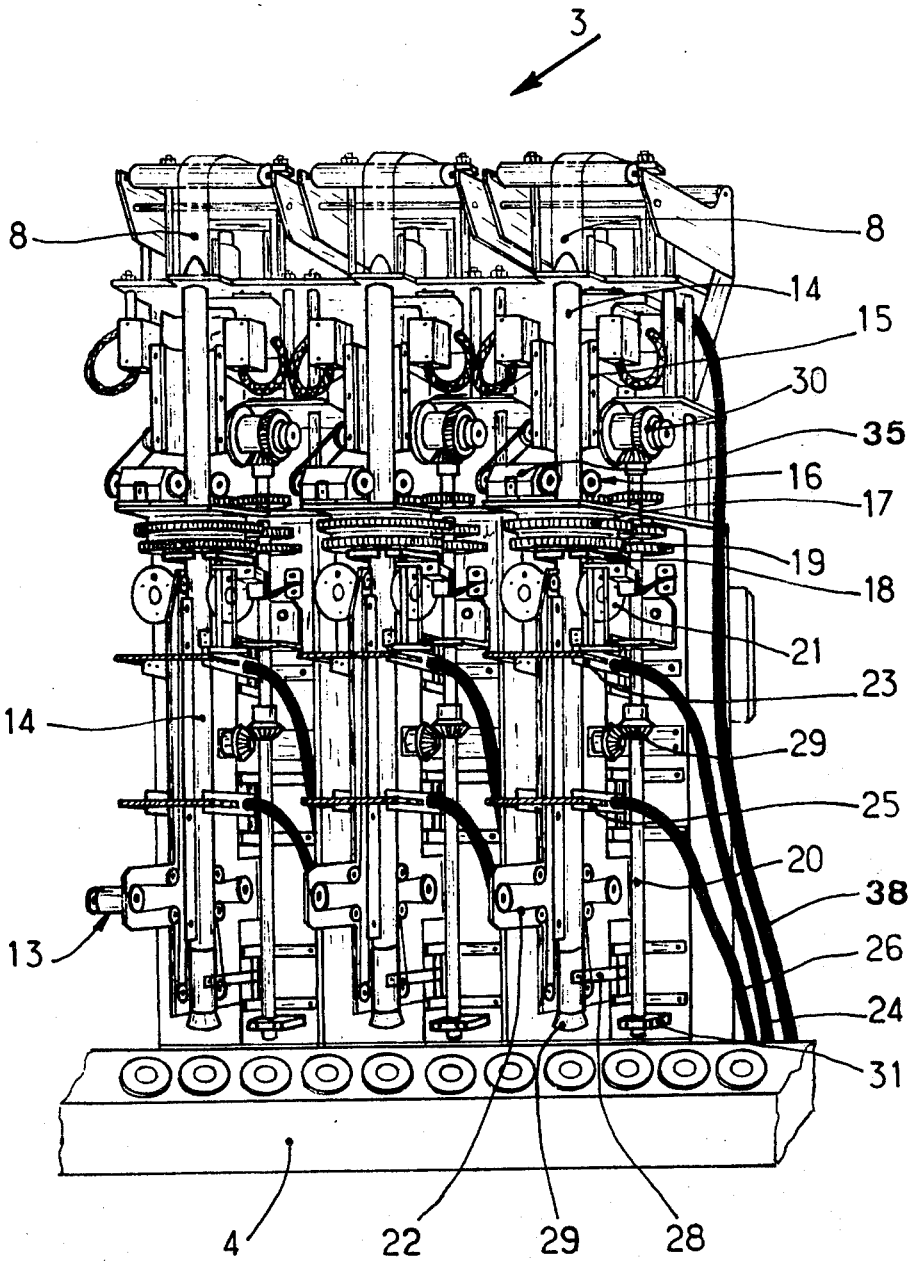
FIG. 1 is a front perspective view of the principal parts of an apparatus according to an illustrative embodiment of the invention.
Figure 2:
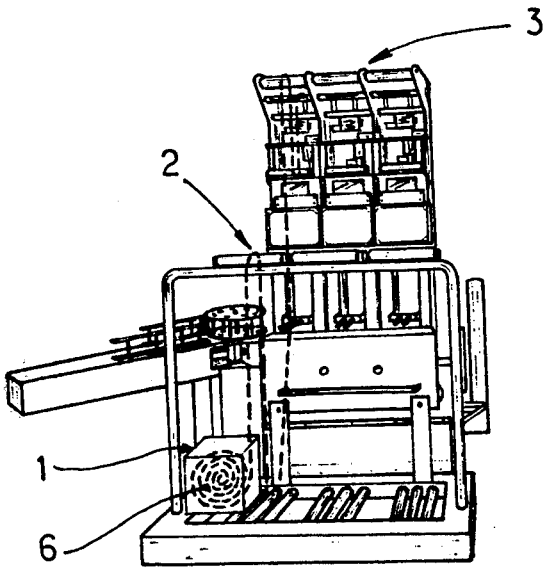
FIG. 2 is a rear perspective view of the apparatus shown in FIG. 1.
Figure 3:
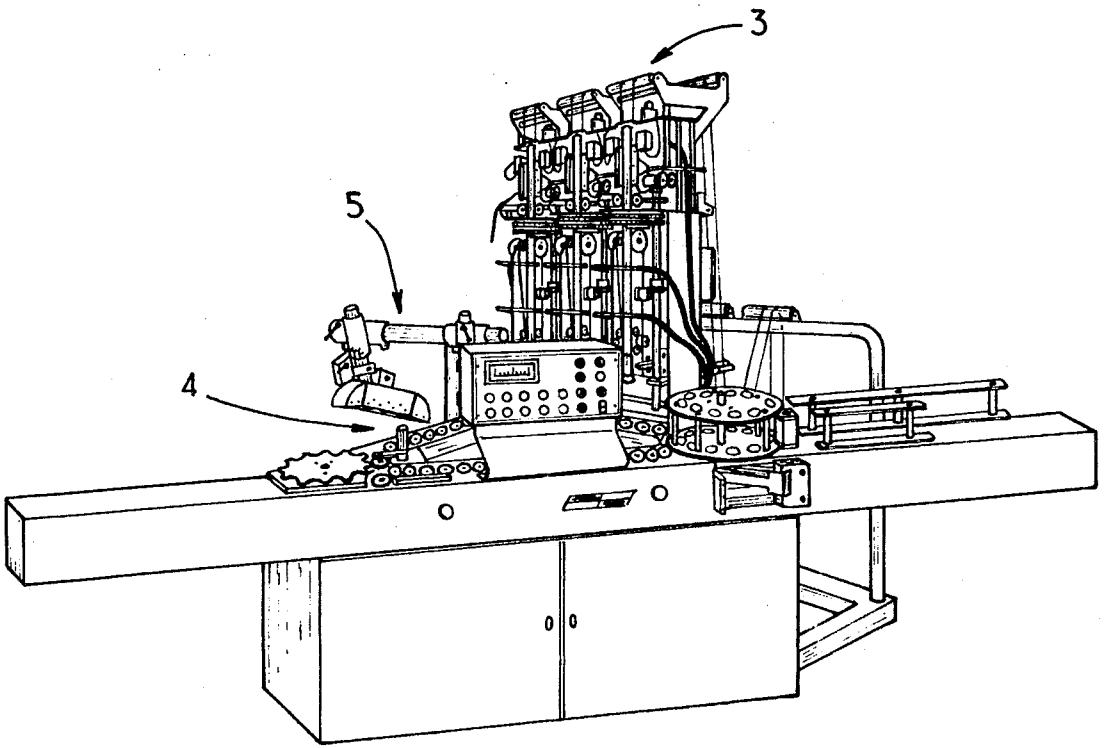
FIG. 3 is a pictorial view of the apparatus shown in FIGS. 1 and 2, associated with a continuous conveyor for the containers and a device for heat-shrinking of the sleeves which have been placed around containers.

With reference to FIGS. 1–3, an illustrative apparatus according to the present invention includes a magazine 1 for feeding of a flat sheath of thermoplastic film; an arrangement 2 for winding and distribution of the sheath; one or more vertical assemblies 3 (the apparatus shown contains three assemblies) operatively arranged for cutting the sheath and then guiding and placing the sheath sections around the containers. Finally, a series of mechanisms are provided to effect the required movements of the various elements, as well as means for controlling the transfer and opening-closing movements of the stages of each vertical assembly. As will be described more in detail below, the apparatus is installed above a conveyor 4, best shown in FIG. 3, intended for continuously bringing the containers to be covered in the covering station. A device 5 for heat-shrinking of the sleeves after they have been placed around each container is provided above the conveyor.

Figure 4:
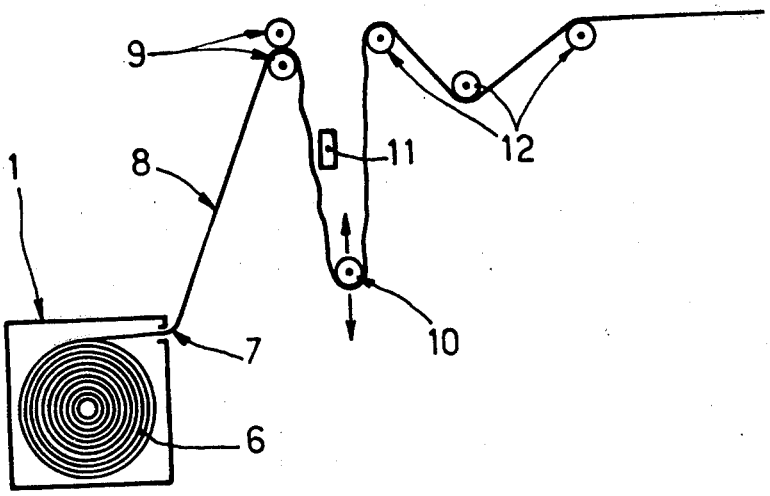
FIG. 4 is a somewhat schematic illustration of an arrangement for putting under tension and slackening the thermoplastic sheath as it is being supplied to the vertical assembly for cutting thereof, and subsequent transfer and placing of the resulting sections or sleeves about the containers.

A magazine or package 1 is advantageously made up of a parallelopedic box, for example of cardboard, in which are placed vertically side by side, separated by crosspieces, for example two reels 6 of plastic sheath wound flat such as obtained by continuous fusing of the two joined edges of a heat shrinkable plastic film, for example, polyvinyl chloride. Of course, the sheath can be provided with any impressions or decorations by known processes. One reel 6 is kept in reserve, while the other feeds the assembly. The magazine or package 1 is provided with a slot 7 and the sheath 8, as can be seen in FIG. 4, follows a path along which it is subjected to different tensions. At the start, the flat sheath is strongly pulled in traction by rolls 9, and then it is slackened by means of a flexible purchase system illustrated by a vertically moving roll 10, passing in front of a photoelectric cell 11. Thus, there is created a reserve of sheath during the later cutting operation. The cell 11 makes it possible to sense the position of the sheath and initiate action to put the sheath under tension to deliver a new length of section on the assembly 3. Driving of the continuous strip to a point above the assembly 3 is performed between a series of rolls or rollers 12 driven by a motor 13. As described in more detail hereinbelow, this single motor 13 drives the brake-clutch series provided for operation of the mobile elements of the apparatus, and also the camshaft for driving the elements of each of the vertical assemblies 3.

When the thermoplastic sheath 8 passes over the upper part of the assemblies 3, it can be subjected, if desired, to a precutting operation before being engaged around the tapered head of the hollow mandrel 14. This operation, which can be performed, for example, with a toothed blade penetrating into a rubber counterpart, makes it possible later to obtain a cleaner and faster cut of the sheath 8 into sections.

After its engagement, at the start of unwinding from the reel 6, around the head of the mandrel 14, the sheath 8 is subjected to the operations of: fold line or pleat removal, cutting, transfer, and placing of the resulting sleeves around the containers to be covered, all these operations being performed synchronously, as described hereinbelow, in each of the vertical assemblies 3.

Figure 7:
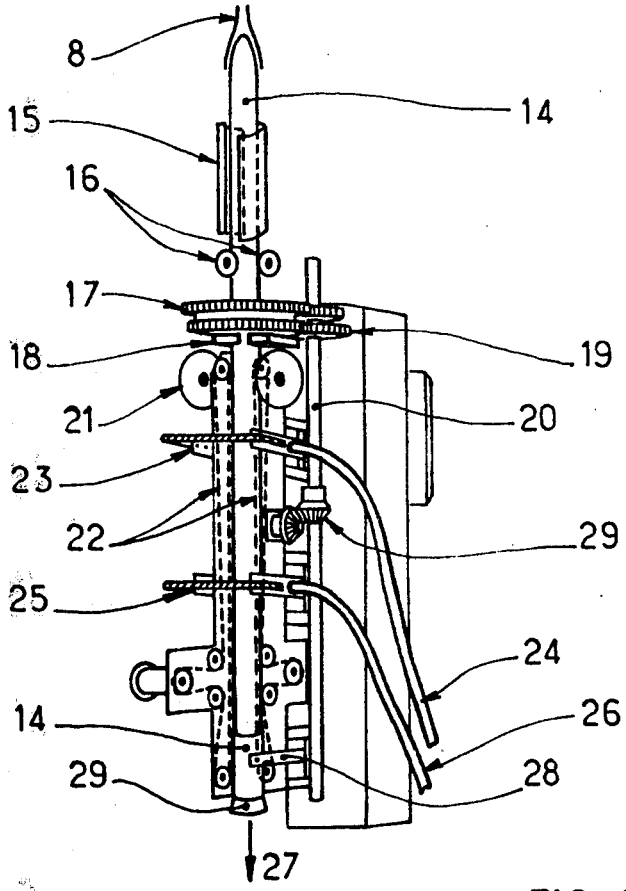
FIG. 7 is a simplified, elevational view of a vertical assembly somewhat schematically showing the main elements of a vertical assembly.

Each vertical assembly essentially comprises, arranged around the associated vertical hollow mandrel 14, a series of stages or stations made up from top to bottom, as best seen in FIGS. 1 and 7, by:

heating jaws 15 for removal of the fold lines or pleats from the sheath after fitting of the latter on the upper portion of the mandrel 14;

sheath guide rollers 16;

cutting release disks 17 engaging with a cutting device 18, these disks meshing on pinions 19 of a camshaft 20;

rollers 21 with associated chains 22 for effecting downward movement of the sheath section already cut;

a first platform 23 at the level of which there is fed to the inside of the mandrel 14 air under slight pressure by conduit 24 intended to aid the downward transfer of the sleeve on an air cushion;

a second platform 25 at the level of which air under greater pressure is fed to the inside of the mandrel 14 to assure ejection of the sleeve onto the container, to be covered, the ejection taking place in the direction of arrow 27;

a third platform 28 close to the lower end of the mandrel 14, which advantageously ends in a truncated cap 29, making it possible to achieve a perfect alignment of the container as it passes under the mandrel 14; and a motion transfer assembly to effect opening-closing movements of the three stages or stations which correspond to platforms 23, 25, 28, by being driven by the camshaft 20 driven by the motor 13 and whose pinion units 19, 20, 30, 31 mesh with the various elements mentioned above which work around the hollow mandrel 14.

Of course, the series of supply conduits, cables and accessory elements are not shown in the figures of the accompanying drawings to improve clarity and facilitate understanding.

A more detailed description of certain essential elements of a vertical assembly of the apparatus is set out below.

The mandrel 14 which can have any shape, for example, cylindrical, is made of a hollow element, of plastic, metal, or alloy, whose wall is provided with microperforations intended to allow the escape of a low of air or other fluid fed into its interior. The mandrel 14 is constantly held and directed in the vertical position by at least one of the platforms 23, 25 and 28.

Figure 5:
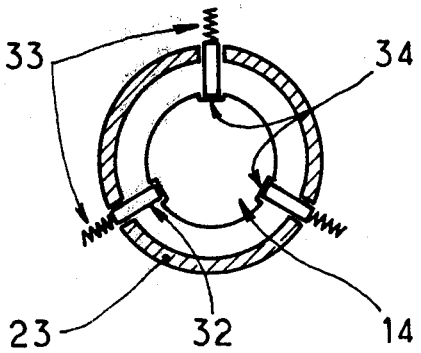
FIG. 5 is an illustration, partially in section, of an arrangement for holding the central portion of the mandrel by a platform of one of the stages of the vertical assembly.

For example, as can be seen in FIG. 5, a platform, for example platform 23, is provided with several pins 32, operated by springs 33 or other means. These pins 32 being housed in a groove or slot 34 provided on the periphery of the mandrel 14. According to a variant, not shown in the figures, the mandrel can be kept at the level at least of one of platforms 23, 25, 28 by a jaw fitting a suitable housing of the mandrel.

When the sheath is carried in its descent on the mandrel 14 by the rollers 16 driven by the brake-clutch 35 connected to the camshaft, this sheath is subjected to fold line or pleat removal by the heating jaws 15 made, for example, of two metal half shells coated on the inside with a plastic (silicone rubber or the like) intended to avoid any possible local overheating. Because of this design, these half shells become true on the mandrel 14, by themselves.

After fold line or pleat removal, the sheath is subjected to cutting, for example, by a rotary blade device, designated by the numeral 18 in FIGS. 1 and 7, which is also driven by the motor 13 and whose blades go into the film after they have been placed in rotation. According to a particular embodiment, there can be added to this cutting device a microperforation system intended to create an additional precutting line in a given zone of the sheath.

At the level of the cut and preferably just below or just above, depending on whether the sheath has printing or not, is installed a photoelectric cell (not shown) which makes it possible to determine the suitable length of each sheath section.

As set out above, the opening and closing functions of each of the stages or stations delimited by the platforms 23, 25, 28, along the mandrel 14 are controlled by various pinions of the camshaft 20. The downward transfer and ejection of the sleeve (arrow 27) are facilitated by pressurized air delivered by the conduits 24 and 26. The third conduit 38, which can be seen in FIG. 1, is connected to a jack (not shown) which feeds the possible precutting device that can be installed above the assembly 3.

Figure 6:
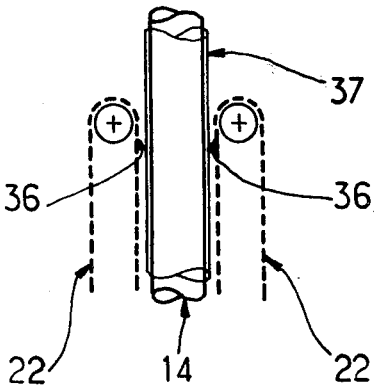
FIG. 6 is a somewhat diagrammatic illustration of a chain driving arrangement for a sleeve along the central portion of the mandrel of each vertical assembly.

According to a characteristic of the invention, there is installed on each side of the mandrel 14 a chain 22 provided with a projecting pin or dog 36 (see FIG. 6) and which, driven by the camshaft 20, accompanies the progression of the cut sleeve 37 downward, the movement of this chain being synchronized with the opening and closing operations of the stages or stations.

A succinct description of operation of the embodiment of the apparatus described above provides a better understanding of the invention; such a description is set out below.

When the sheath 8, possibly precut, is fitted onto the mandrel 14 (beginning of reel), the mandrel 14 is held in position by closing of the pins 32 provided on the platform 28 of the lower stage or station (rest position). The platforms 23 and 25 are open when the platform 28 is closed; the guide rollers 16 are started to cause the sheath to descend over the length of cut to be made. A signal provided from a photocell or the like (not shown) causes these rollers 16 to stop and controls the heating and pressing operation of the jaws 15 to remove the pleats or fold lines, then enables the cutting device 18. At the end of the cutting, detected by contactor, the rotation of the rollers 21, of camshaft 20 and movement of the chains 22 are effected for moving the cut section of the sheath. The camshaft turns, closing the stage or station delimited by the platform 23 and opens the stage or station defined by the platform 25. During this time, the chain 22 assures the passage of the sheath section to the stage or station defined by the platform 25. The camshaft 20 continues to turn assuring closing of the stage or station delimited by the platform 25 and opening of the stage or station defined by the platform 28. The sheath section then continues its travel until the pin chain 22 has ejected, with the air pressure provided via the conduit 26, the sleeve from the hollow mandrel 14. At this moment, lower the stage or station delimited by the platform 28 is closed, when the upper stage or station delimited by the platform 23 is open and the cycle recommences in the order indicated above.

Because the apparatus as illustrated is provided with three vertical assemblies, such as shown in FIGS. 1, 2 and 3, it is possible to obtain a placement rate of about 120 sleeves per minute around the containers to be covered.

In practice, as shown in FIG. 3, the apparatus is installed above the conveyor 4 intended continuously to bring the containers which are to receive sleeves into position. It is possible to use for this purpose, for example, the conveyor described in French Pat. No. 75.30896 of Oct. 9, 1975, Patents of Addition Nos. 75.36299, 76.08851 and 76.39546 and U.S. Pat. No. 4,066,866. Such an endless conveyor belt is provided with a heating tunnel 5 operatively arranged to perform heat shrinking of the sleeves around the containers brought by the conveyor and covered with a sleeve from the vertical assembly 3.

Of course, any other elements with equivalent function can be substituted for those described in the above non-limiting example without thereby going outside the scope of the present invention, its scope being defined by the appended claims.

What is claimed is:

1. An apparatus for automatic cutting at a programmed rate heat-shrinkable plastic sheaths into sleeves and placing the sleeves around containers, the sleeves being suitable for then being heat-shrunk around the containers, the apparatus comprising: a conveyor; a frame; means for heat-shrinking the sleeves; means on said frame for feeding a plastic sheath in flat form and for conveying it as a continuous web under predetermined tension conditions; at least one hollow mandrel; at least one vertical assembly means on said frame for cutting the sheath into sleeves and for supplying the sleeves around said hollow mandrel on which the continuous sheath is to be engaged, the assembly means including at least the following stations:

(a) means for removing pleats and fold lines on the flat sheath;

(b) means for cutting the sheath into the sleeves;

(c) staged means for automatically regulating height and rate of the cutting and at the same time for making it possible to keep said mandrel in its vertical position; and (d) means for guiding and ejecting the sleeves downward from said mandrel, these sleeves being automatically placed around the containers to be covered which are travelling on said conveyor, said conveyor being operatively associated with said means for heat-shrinking the sleeves around the containers.

2. An apparatus according to claim 1, including flat sheath supply means composed of a plurality of reels enclosed in a package delivering the sheath via horizontal slots in said package; and wherein said means for conveying the sheath comprise means for conveying the sheath alternately under high tension then under slack using a flexible purchase assembly to permit laying out a length suitable for cutting into a sleeve.

3. An apparatus according to claim 1, wherein the sheath pleat and fold line removal means comprise heating jaws whose time of application on said mandrel is programmed in sequence with the cutting of the sheath and as a function of the heating temperature.

4. An apparatus according to claim 1, wherein the sheath cutting means are made of a rotary device with one or more blades or knives, which engage on the sheath when they are already in rotation around the mandrel.

5. An apparatus according to claim 1, wherein said staged means comprise platforms concentric with said mandrel and provided with retractable pins intended to engage in grooves provided on said mandrel, these platforms delimiting at least two stages or stations for regulating the height of cut, downward transfer of the sleeve and its ejection from the end of said mandrel.

6. An apparatus according to claim 1, wherein the means for guiding the sleeves onto said mandrel and for ejecting the sleeves from the mandrel comprise a combination of delivery rollers, pin chains accompanying the descent of each sleeve, means for sending pressurized fluid onto at least one point of said hollow mandrel; and microperforations on the periphery of said hollow mandrel at least on one level for allowing escape of the pressurized fluid.

7. An apparatus according to claim 1, wherein said means for removing the pleats and fold lines from the sheath and said means for cutting and said means for guiding and ejecting the sleeves are controlled by a central camshaft connected to a series of pinions, said shaft assuring synchronization between the successive openings and closings of said stations of said vertical assembly.

8. An apparatus according to claim 1, including means for subjecting the continuous flat sheath to a precutting operation before its introduction around said mandrel of said vertical assembly.

9. An apparatus according to claim 1, wherein the lower end of said hollow mandrel is provided with a cap truncated in shape, making it possible to align said mandrel perfectly with individual containers to be covered.

* * * * *